US008595983B2

(12) United States Patent
Gaviglia

(10) Patent No.: US 8,595,983 B2
(45) Date of Patent: Dec. 3, 2013

(54) DOOR AND SYSTEM PROVIDING RADIO FREQUENCY SHIELDING AGAINST HIGH-ALTITUDE ELECTROMAGNETIC PULSE

(75) Inventor: John J. Gaviglia, Glenshaw, PA (US)

(73) Assignee: Gaven Industries, Inc., Saxonburg, PA (US)

( * ) Notice: Subject to any disclaimer, the term of this patent is extended or adjusted under 35 U.S.C. 154(b) by 147 days.

(21) Appl. No.: 13/091,448

(22) Filed: Apr. 21, 2011

(65) Prior Publication Data

US 2011/0258934 A1 Oct. 27, 2011

Related U.S. Application Data

(60) Provisional application No. 61/327,174, filed on Apr. 23, 2010.

(51) Int. Cl.
*E06B 7/16* (2006.01)

(52) U.S. Cl.
USPC ..... 49/477.1; 49/501

(58) Field of Classification Search
USPC ..... 49/400, 401, 402, 381, 475.1, 477.1, 49/484.1, 501, 504
See application file for complete search history.

(56) References Cited

U.S. PATENT DOCUMENTS

| | | | | |
|---|---|---|---|---|
| 2,757,225 | A * | 7/1956 | Dunn | 174/364 |
| 3,051,260 | A * | 8/1962 | Eckel | 181/287 |
| 3,449,864 | A | 6/1969 | Prost-Dame et al. | |
| 3,507,974 | A * | 4/1970 | Clark et al. | 174/367 |
| 3,747,275 | A | 7/1973 | May et al. | |
| 3,872,541 | A * | 3/1975 | Peterson | 16/223 |
| 3,984,942 | A * | 10/1976 | Schroth | 49/477.1 |
| 4,073,521 | A * | 2/1978 | Mena | 292/256.65 |
| 4,177,353 | A * | 12/1979 | McCormack | 174/374 |
| 4,207,706 | A * | 6/1980 | Haines | 49/141 |
| 4,335,075 | A * | 6/1982 | Kackos | 422/112 |
| 4,371,175 | A | 2/1983 | Van Dyk, Jr. | |
| 4,399,317 | A * | 8/1983 | Van Dyk, Jr. | 174/364 |
| 4,469,335 | A * | 9/1984 | Moore | 277/648 |

(Continued)

OTHER PUBLICATIONS

Department of Defense Interface Standard, High-Altitude Electromagnetic Pulse (HEMP) Protection for Ground-Based C4I Facilities Performing Critical, Time-Urgent Missions, Part 1 Fixed Facilities; MIL-STD-188-125-1-1; Jul. 17, 1998.

(Continued)

*Primary Examiner* — Katherine Mitchell
*Assistant Examiner* — Justin Rephann
(74) *Attorney, Agent, or Firm* — David G. Oberdick; Peter J. Borghetti

(57) ABSTRACT

Pneumatic door system of fluid lines, valves, switches, and sensors integrated into hinge mechanisms, door frame, and door connected to a fluid pressurization system to inflate and deflate one or more fluid seals attached to outer perimeter of door adjacent to inner perimeter of door frame to close gap between outer perimeter of door and inner perimeter of door frame to provide radio frequency shielding against, for example, high-altitude electromagnetic pulse. Air seal creates a substantially impermeable barrier against radio frequency transmission, as well as air infiltration, when fully inflated. Separate fluid channels in each component interconnect to act as one fluid circuit or network when door is closed. Pneumatic door system can be fluidly connected to a conventional fluid pressurization system in communication with a programmable logic controller to respond to user input or automatic commands with system overrides to react to system air pressure and air flow conditions.

17 Claims, 14 Drawing Sheets

(56) References Cited

U.S. PATENT DOCUMENTS

| | | | | |
|---|---|---|---|---|
| 4,665,653 | A * | 5/1987 | Franz et al. | 49/477.1 |
| 4,722,151 | A | 2/1988 | Westwell | |
| 4,953,324 | A * | 9/1990 | Herrmann | 49/255 |
| 4,982,053 | A * | 1/1991 | Thornley et al. | 174/366 |
| 4,995,196 | A * | 2/1991 | Smith | 49/477.1 |
| 5,079,873 | A * | 1/1992 | Smith | 49/477.1 |
| 5,085,293 | A | 2/1992 | Aime | |
| 5,181,341 | A * | 1/1993 | Keys et al. | 49/477.1 |
| 5,214,241 | A | 5/1993 | Benwell | |
| 5,220,696 | A * | 6/1993 | Dannenberg et al. | 4/556 |
| 5,749,175 | A | 5/1998 | Koike et al. | |
| 6,195,941 | B1 * | 3/2001 | Burow et al. | 49/477.1 |
| 6,519,899 | B1 | 2/2003 | Hurzeler | |
| 7,117,640 | B2 | 10/2006 | Hurzeler | |
| 7,246,681 | B2 | 7/2007 | Christen | |
| 7,578,097 | B2 * | 8/2009 | Dondlinger et al. | 49/477.1 |
| 8,347,649 | B1 * | 1/2013 | Gavin et al. | 62/440 |
| 2010/0132264 | A1 * | 6/2010 | Campbell et al. | 49/477.1 |
| 2011/0061301 | A1 * | 3/2011 | Gaviglia | 49/70 |

OTHER PUBLICATIONS

Department of Defense Interface Standard, High-Altitude Electromagnetic Pulse (HEMP) Protection for Ground-Based C4I Facilities Performing Critical, Time-Urgent Missions, Part 2 Transportable Systems; MIL-STD-188-125-2-2; Mar. 3, 1999.

http://www.jaycor.com, 4 pages, Jul. 14, 2009.

ETS-Lindgren, An ESCO Technologies Company, Auto-Seal II Door RF-Shieled, Acoustic and Fire-Rated, Sales Brochure, Copyright 2003.

* cited by examiner

DOOR AND SYSTEM PROVIDING RADIO FREQUENCY SHIELDING AGAINST HIGH-ALTITUDE ELECTROMAGNETIC PULSE

CROSS-REFERENCE TO RELATED APPLICATIONS

This application is a Non-provisional Application of U.S. Provisional Application No. 61/327,174, titled DOOR AND SYSTEM PROVIDING RADIO FREQUENCY SHIELDING AGAINST HIGH-ALTITUDE ELECTROMAGNETIC PULSE, filed on Apr. 23, 2010, herein incorporated by reference.

FIELD OF THE INVENTION

This invention relates to a door providing radio frequency ("RF") shielding against high-altitude electromagnetic pulses (HEMP).

BACKGROUND OF THE INVENTION

RF shielding and RF shielded rooms/shelters for military and other government uses have been in use for some time. The United States military provides specifications for such shelters at Mil-Std-188-125-1 and Mil-Std-188-125-2 (HEMP Shelters), which are incorporated herein by reference (see web site http://www.everyspec.com/MIL-STD/MIL-STD+(0100+-+0299)/MIL-STD-188_125_1-1_4470/ and http://www.everyspec.com/MIL-STD/MIL-STD+(0100+-+0299)/MIL-STD-188-125-2(NOTICE_1)_4473/).

Historically, these government specifications have been met exclusively through use of a so-called "knife edge" door, i.e., a door design in which an RF seal is created where the door joins the door frame by a brass knife edge on the door enters a channel on the door frame. An example of this type of door is shown at http://www.etslindgren.com/pdf/iSKE.pdf; http://www.jaycor.com.

This knife-edge door design has numerous disadvantages, however. Because the knife and channel are made of brass, corrosion occurs and creates non conductive zinc and copper oxides. This oxidation in turn decreases the RF shielding effectiveness of the door seal.

In addition, the channel traps water dirt and contaminants, whereby shielding performance degrades exponentially. Also, the channel is extremely difficult to clean. Typically, cleaning requires removal of the fingerstock in the channel (that is, brass receiving "fingers" that help create an electrical seal with the knife edge in the channel. The fingerstock, when removed, often gets damaged and cannot be reused. Also, all corrosion has to be removed from channel and knife edge surfaces, which is difficult. A conductive lubricant can be used on the brass surfaces to slow corrosion. However, the silicone lubricant traps and holds dirt and dust particles reducing shielding effectiveness.

In addition, water freezes in channel rendering the door inoperable in cold climates. Moreover, the knife edge can wear below serviceable limits in dry sandy environments requiring replacement of entire door within 5 years. In this event, the HEMP enclosure has to be removed from service until repaired The knife edge design also presents disadvantages because the doors using this design cannot be opened or closed without mechanical assistance. Large lever and cam mechanisms are required to open and close the knife edge door. Appreciable wear on the fingerstock and knife edge occurs because of this mechanical opening action. There are two conditions that make the door difficult to operate: 1—the beryllium copper fingerstock are heat treated, or tempered, to make them springy. This process also hardens them. When the surface of the fingerstock begins to wear and become microscopically abraded, it digs in and grabs the softer brass knife edge requiring more and more effort to operate the lever mechanism. This can be visually confirmed by the grooves that each of the fingers eventually wears into the brass knife edge; 2—the lever mechanism only unseats the knife edge on the strike side of the door requiring the operator to manually pull the door's knife edge completely out of the channel and fingerstock at the top, bottom and hinge side and to push the door in until the lever mechanism can be engaged.

Very high maintenance is required for the knife edge door design. In particular, weekly flushing of the channel with solvents is required to remove loose dirt. In addition, weekly lubrication with conductive lubricant of the fingerstock in the channel is recommended. For the reasons discussed above, monthly or quarterly replacement of fingerstock occurs—with associated down time—based upon usage of the knife edge door. Fingerstock replacement requires special tools and takes approximately 1 hour. Moreover, monthly or quarterly lubrication of the mechanical operating mechanism is required based upon usage. Other repair needs include repair and replacement of worn beyond limits parts in the operating mechanism. Finally, the operating mechanism shaft seal needs periodic replacement to maintain shielding effectiveness.

Additional problems with the knife edge design arise because the brass knife edge can be bent causing misalignment—which makes the door difficult if not impossible to operate and causes a loss of shielding effectiveness. Similarly, the knife edge at the sill cannot be stepped on as damage will occur. The sill must be protected by a steel plate or wood ramp of sufficient strength if furniture, fixtures or supplies need to be wheeled or carted through the door. The knife edge design does not meet ADA door sill height requirements of less than ½", and commonly requires a 2-3" step over.

SUMMARY OF THE INVENTION

The present invention satisfies that military specifications for a HEMP shelter, but avoids the disadvantages of the knife edge design by using a novel air seal and hinge design. In particular, the present invention, by way of example but not limitation uses an all 304 stainless steel construction for the door and frame which exceeds all shielding performance requirements of Mil-Std-188-125-1 and Mil-Std-188-125-2 The present invention further employs tin plated air seal gasket material that avoids the corrosion problems associated with the knife edge door design because tin oxides are as conductive as tin or similar non-corroding materials such as stainless steel or monel. As a result, shielding effectiveness remains constant.

In addition, the air seals which are attached to the door hinge leaf assembly of the present invention retract significantly or completely when deflated, having little or no surface contact with the inside of the door frame assembly. When the air seals are inflated they expand, pushing the outer metallic woven or braided material of the air seal firmly against both the outer perimeter of the door hinge leaf and the inner perimeter of the door frame creating a continuous electrically conductive path between the two assemblies. When the air seals are deflated, they contract to reduce or eliminate frictional loading between the door and the door frame assembly for ease of opening the door. Since the air seals are attached to the outer perimeter of the door hinge leaf of the door, they move away from the inner perimeter of the door frame assembly when deflated. This creates a "zero friction" or "near zero friction" condition enabling the door to swing opened or closed as freely as any standard commercial door. No mechanical assist through levers or cams is required to open or close the invention as is required by the currently available 'knife-edge' type door. Further advantages of the design of the present invention include, inter alia: (i) the sill of door frame meets ADA height requirements of less than ½"; (ii) cleaning only requires wiping mating surfaces with a dry cloth, (iii) if damaged, the air seal can be replaced within 15 min without any tools, and (iv) the typical size man door weighs less than 200 lbs.

The air supply mechanism to the primary and secondary seals, in addition to helping obviate the disadvantages of the knife edge door, provides the additional advantage of a protected and inaccessible air supply. More directly, because the air supply is internal and integral to the door frame, frame hinge leaf, door hinge leaf and door frame, this assembly cannot be accessed or tampered (such as cannot cut the fluid lines) with from the outside when the door is closed. The benefits of this inaccessibility can be enhanced by providing internal attachments, such as screws, between the door hinge leaf and the door hinge leaf. In a preferred embodiment, all seals and gaskets can be protected against outside access with cover plates.

BRIEF DESCRIPTION OF THE DRAWINGS

The present invention is illustratively shown and described in reference to the accompanying drawings, in which.

DETAILED DESCRIPTION OF THE INVENTION

In general, the invention utilizes a fluid system to activate the sealing and shielding of the door entry from radio frequency ("RF") shielding against high-altitude electromagnetic pulses (HEMP). Though the illustrations and examples are of a pneumatic system, similar or same components can be employed in a hydraulic system depending on the fluid response time requirements. "Fluid" is a substance, such as a liquid or gas, that can flow, has no fixed shape, and offers little resistance to an external stress. The terms "fluid" and "air" are used interchangeably in this application.

One embodiment of the present invention includes a pneumatic door system of fluid lines, valves, switches, and sensors integrated into hinge mechanisms, a door frame, and a door connected to a air pressurization system to inflate and deflate one or more air seals attached to an outer perimeter of the door adjacent to the inner perimeter of the door frame to close a gap between the outer perimeter of the door and inner perimeter of the door frame to provide radio frequency shielding against, for example, high-altitude electromagnetic pulse. The air seal creates a substantially impermeable barrier against radio frequency transmission, as well as air infiltration, when fully inflated. The separate fluid channels in each component interconnect to act as one fluid line or network when the door is closed. The pneumatic door system can be fluidly connected to a conventional air pressurization system, such as a compressor, and in communication with a programmable logic controller to respond to user input or automatic commands with system overrides to react to system air pressure and air flow conditions. The system can operate manually or automatically.

Figure 4:
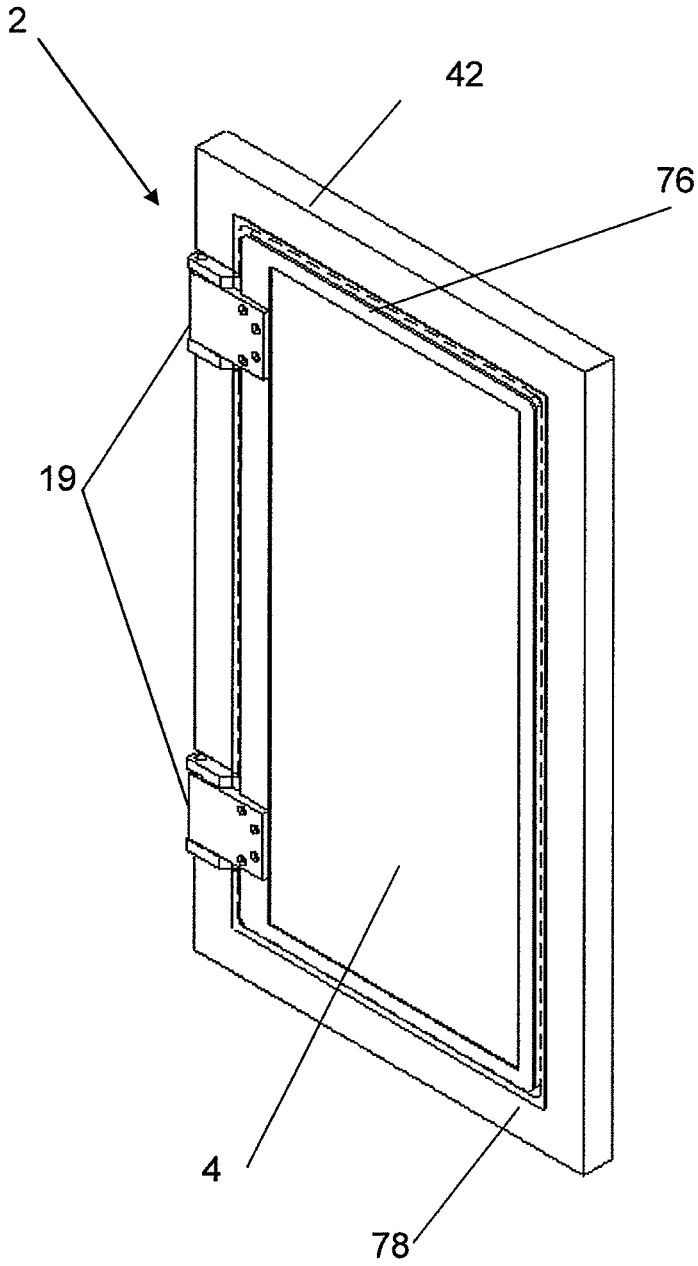
FIG. 4 is a perspective view of the shielded door system of the present invention in the closed position illustrating exemplary components of the system.

FIG. 4 is a perspective view of the shielded door system 2 of the present invention in the closed position illustrating exemplary components of the system: door 4, door frame 42, seal guards 76 on both sides of door 4; and hinges 19. Inflatable air seals, discussed in detail below, are protected by seal guards 76.

Figure 1A:
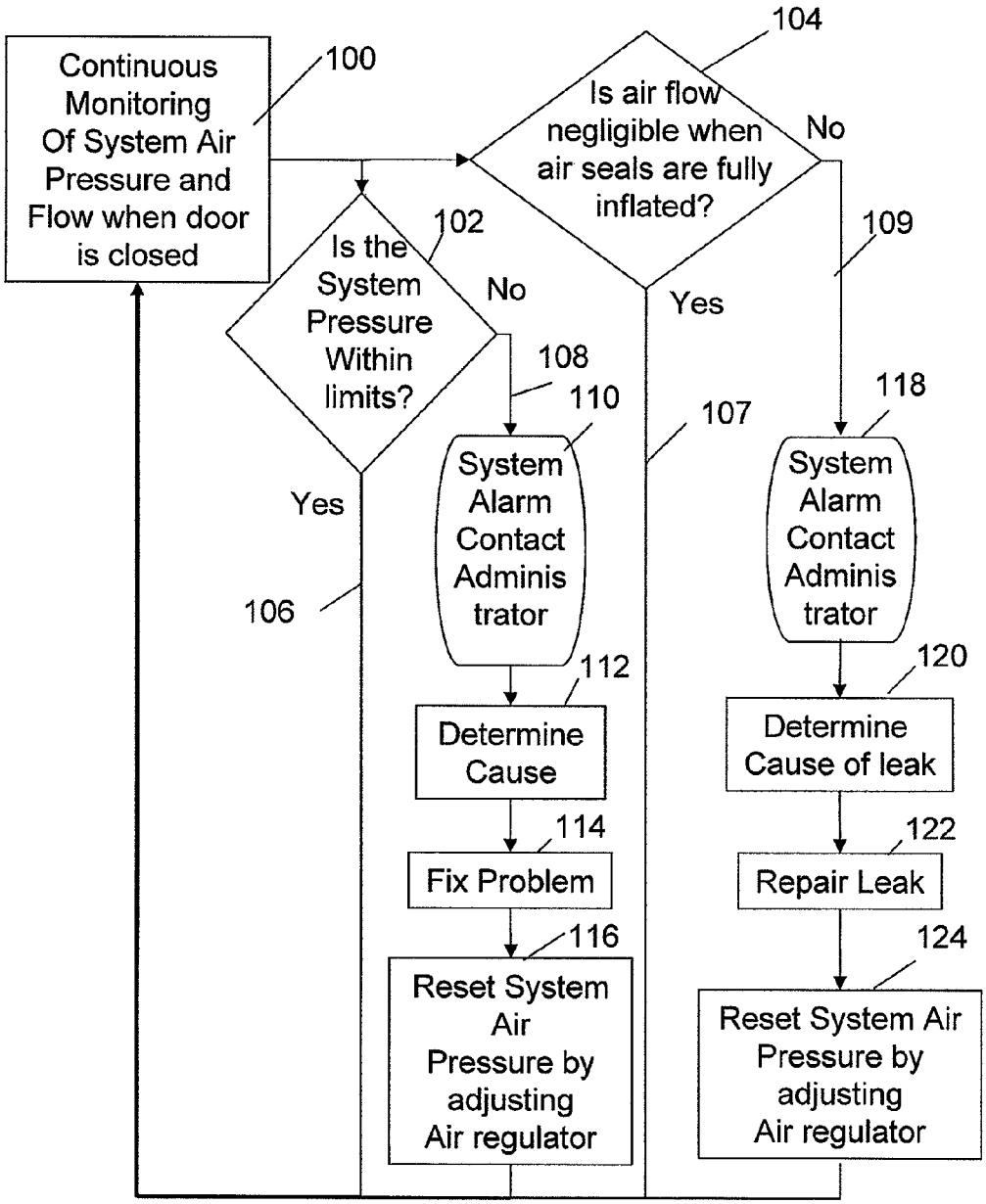
FIGS. 1A and 1B are flow chart illustrations of an example of a logic and fluid condition monitoring system of the present invention.
Figure 1B:
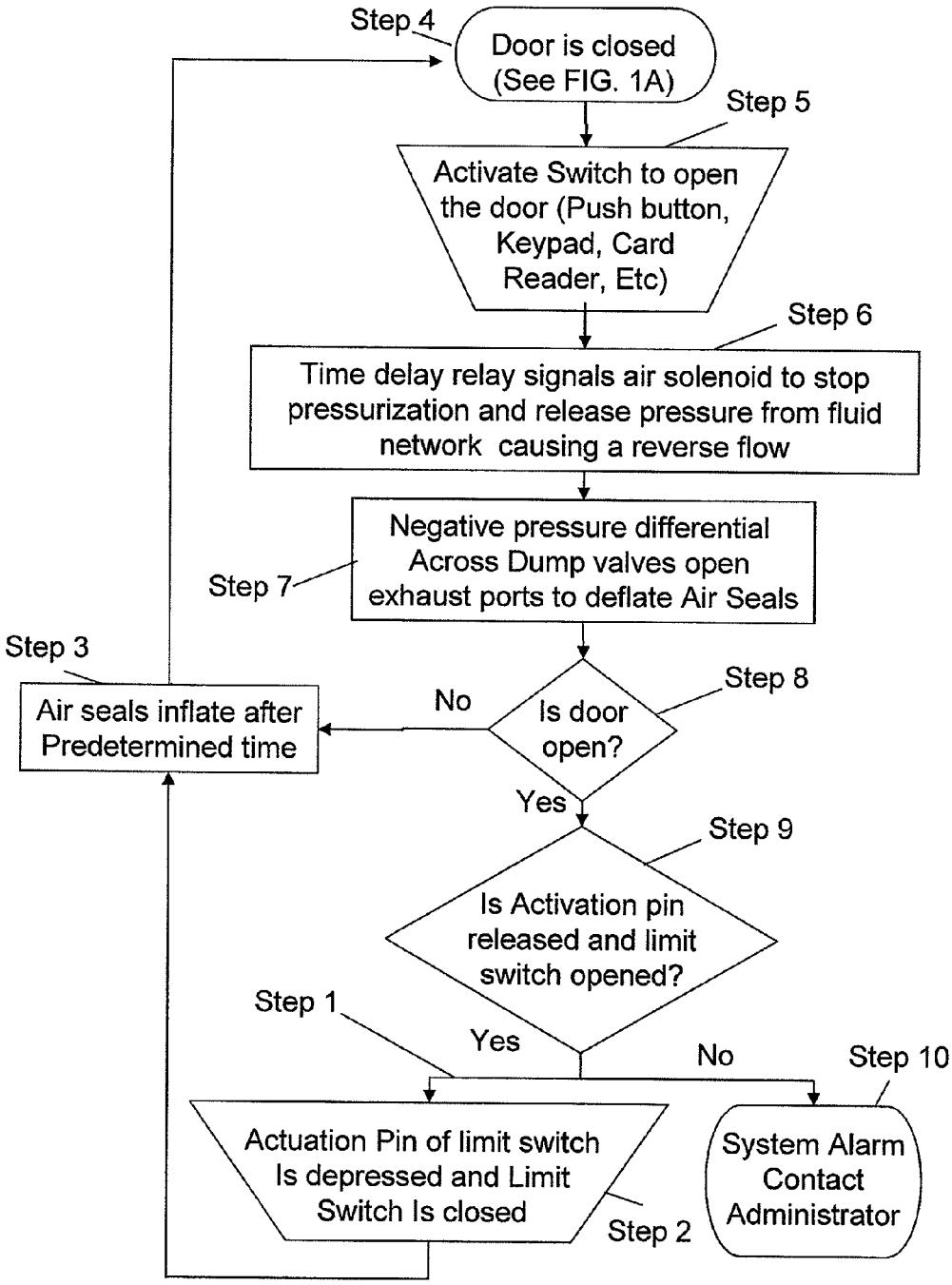
Figure 2A:
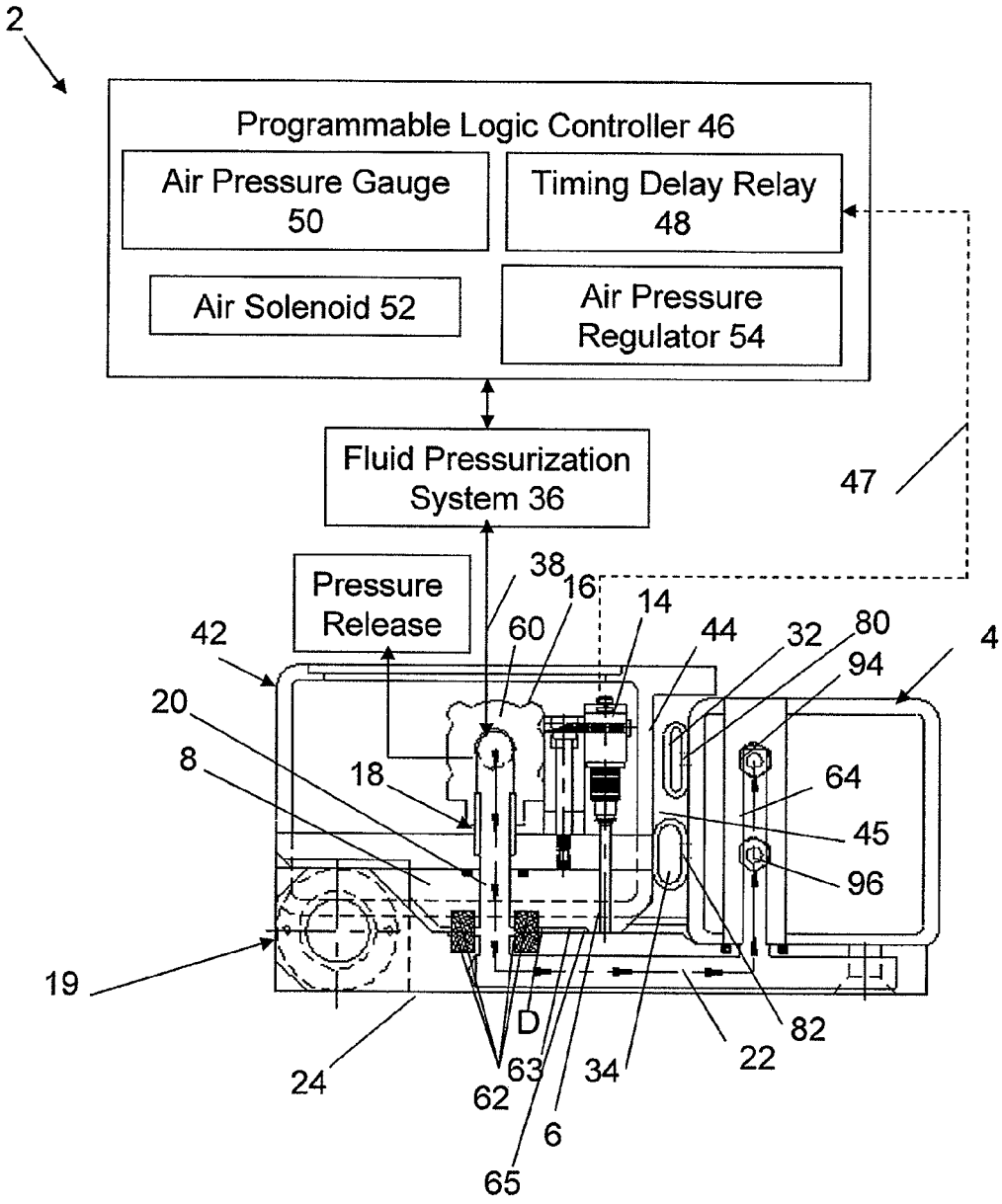
FIG. 2A is a horizontal cross-sectional view of the door frame, hinge, door, and air seals of the shielded door and Programmable Logic Controller of the present invention illustrating air flow actuation mechanisms and flow path therethrough when the door is closed.
Figure 2B:
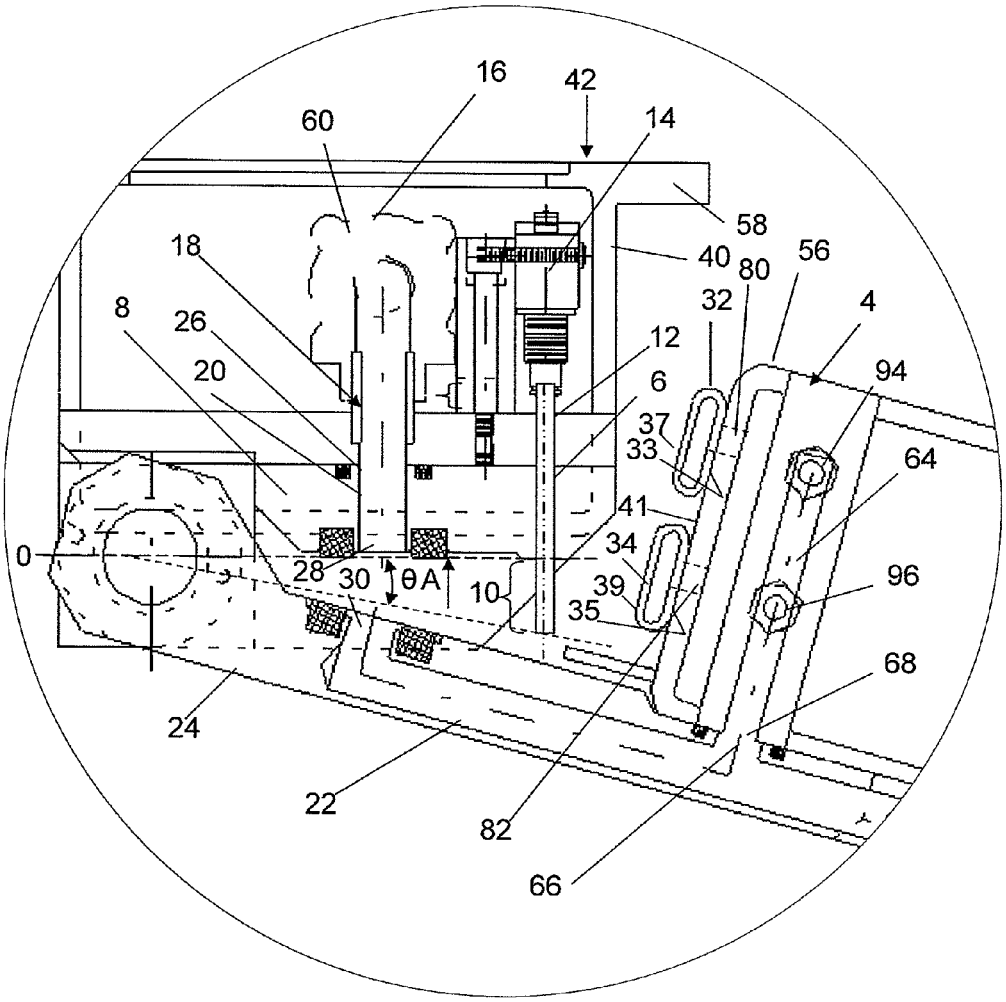
FIG. 2B is a horizontal cross-sectional view of the door frame, hinge, door, and air seals of the shielded door of the present invention illustrating fluid actuation pin travel when the door is opened.

FIGS. 1A and 1B are flow chart illustrations of examples of a logic and air monitoring system of the present invention. However, other variations of the steps are contemplated within the scope of the invention and the invention is not to be limited to the disclosed example. FIGS. 2A and 2B are illustrations of exemplary components of System 2 that implement the steps of FIGS. 1A and 1B. One embodiment of the present invention includes a limit switch 14 that is responsive to the axial position of an air actuation pin 6. Limit switch 14 is integral with door frame 42. Air actuation pin 6 is biased relative to limit switch 14 by an internal spring (not shown). For example, when door 4 is in an open position (FIG. 2B), limit switch 14 with an internal spring mechanism (for example limit switch manufactured by Omron, part number Z-15GQ-B7-K) pushes a portion of air actuation pin 6 outward to extend out of frame hinge leaf 8 to define a travel distance 10 of air actuation pin 6 through pin hole 12. When door 4 is closed (FIG. 2A), air actuation pin 6 contracts inner surface 90 of door hinge leaf 24 at door angular position θ, an angle of the frame hinge leaf relative to the door hinge leaf, to retract air actuation pin 6 into pin hole 12 traveling distance 10 (FIG. 2B) to close limit switch 14 that sets timing delay relay 48 to activate air solenoid 52 to allow air to flow through fluid circuit 18 to air seals 32, 34. See FIG. 1B—Step 1. Air actuation retraction occurs when the door angular position θ is equal to or less then the predetermined angle. Travel distance 10 can be used as a timing mechanism to initiate the air flow from pressurization system 36 to air seals 32, 34 depending on the responsiveness of the pressurization system 36 due to viscosity of the fluid and/or length of network of fluid lines 38 connecting pressurization system 36 to door frame valve 16, as well as pressure losses with fluid circuit 18. Travel distance 10 can be lengthened or shorted to adjust timing of the air activation. Limit switch 14 being integral to door frame 42 with air actuation pin 6 being retractable into door frame 42 and covered by inner surface 90 of door hinge leaf 24 provides additional security that the limit switch cannot be tampered with to override the air actuation system to open the door from the outside.

As discussed above, one embodiment of the present invention initiates the air flow actuation to seals 32, 34 by pushing door 4 in direction A toward door frame 42 (FIG. 2B) and depressing air actuation pin 6 into air actuation pin hole 12 to close limit switch 14 (FIG. 2A). See FIG. 1B—Step 2. After a predetermined time period, air can begin the inflation of air seals 32, 34 (See FIG. 1B—Step 3) before door 4 is fully closed (See FIG. 1B—Step 4) such that air seals 32, 34 are substantially inflated by the time door 4 is fully closed. "Substantially inflated" means that door frame/seal gap 44 (FIG. 2A) has substantially closed and there is contact between air seals 32, 34 and door frame inner perimeter 40. "Substantially deflated" means that door frame/seal gap 44 exists (FIG. 2A) and there is no contact between air seals 32, 34 and door frame inner perimeter 40. This condition is considered "zero friction." Some embodiments of air seals 32, 34 are allowed to slightly contact (low contact pressure and stress) the door frame inner diameter depending on the amount of force required to open and close the door, and adequate seal wear and life characteristics. This condition is considered "near zero friction." Air seal 32 in FIG. 2A is shown deflated for illustration purposes of gap 44. Typically, air seal 32 will be inflated similar to air seal 34 and makes contact with inner perimeter 40 of door frame 42 to create a substantial seal between door frame 42 and door 4 without gaps, including corners 78 (FIG. 4).

In addition to pin travel distance 10, limit switch 14 can be in direct communication 47 (FIG. 2A) with programmable logic controller 46 to trigger time delay mechanism logic 48 (for example electric timing relay manufactured by Square D, part number 9050JCK31V14) to delay air flow from air pressurization system 36 for a predetermined time period, for example 5 seconds, to account for the opened angular position θ (FIG. 2B) of door 4 relative to door frame 42. System 2 can be programmed to fully inflate air seals 32, 34 by the time door outer surface 56 contacts or is in close proximity of door frame jamb 58 (FIG. 2B).

In addition to controlling the timing of the start of air pressurization system 36, PLC 46 monitors system pressure 50 (for example air pressure gauge manufactured by Wilkerson, part number 5WZ07) and air flow monitoring 52 (for example air solenoid manufactured by Ingersoll-Rand/ARO, part number 35A-SAC-DDAA-1BA). PLC 46 can start and stop pressurization system 36 with air pressure regulator 54 (for example, manufactured by Wilkerson, part number R08-02-F000) when either the pressure or flow exceeds acceptable parameters. System 2 can continuously monitor pressure and air when door 4 is opened or closed.

Now turning to FIG. 1A for an exemplary description of system logic for controlling and maintaining appropriate pressure and air flow within System 2 when door 4 is closed. As stated above, system 2 can continuously monitor air pressure and flow 100 and determine whether the pressure 102 is within limits and flow is negligible when air seals are inflated 104. If the system parameters for pressure and flow are acceptable, then the monitoring continues 106, 107. However, if the system parameters for pressure and flow are not acceptable 108, 109, then system 2 is troubleshot for determination of cause and corrective action. With regards to pressure limits outside limits, the system administrator is contacted 110, who will determine cause 112, fix the problem 114, reset system air pressures by adjusting air regulator 116, and system again continuously monitors pressure 100. With regards to air flow above negligible limits 109, the system administrator is contacted 118, who will determine cause of the leak 120, repair the leak 122, reset system air pressures by adjusting air regulator 124, and system again continuously monitors flow 100. Further, PLC 46 monitors and controls the opening of door 4.

Returning to FIG. 1B, operator activates switch to open door 4 by pushing a button, a keypad, or card reader, or any acceptable input device—Step 5. Time delay relay 48 signals air solenoid 52 to stop pressurization and release pressure from fluid network 18 causing a reverse flow back to air solenoid 52 to open to deflate air seals 32, 34 (FIG. 2A)—Step 6. Negative pressure differential across dump valves 60, 60A, 60B (FIGS. 2A and 8A-D) open exhaust ports to deflate Air Seals—Step 7. If air seal 32, 34 pressures are at ambient conditions, then door will open—Step 8. If door is not open in predetermined time, then air seals 32, 34 are inflated after a predetermined time period—Step 3. If door 4 is opened, then air activation pin 6 position extends from pin hole 12 and limit switch 14 opens—Step 9. If one or both do not meet the condition, then System Alarm will sound and the Administrator will be contacted—Step 10. If air actuation pin 6 is depressed and limit Switch 14 is closed (Step 2), then air seals 32, 34 are inflated after a predetermined time period (Step 3) and the process repeats.

Now turning to FIGS. 2A and 2B, system 2 comprises a fluid circuit 18 located within door frame 42, hinge 19, and door 4. Hinge 19 includes pivotally connected frame hinge leaf 8 and door hinge leaf 24. Frame hinge leaf 8 is removeably connected to door frame 42. Door hinge leaf 24 is removeably connected to door 4. Fluid circuit 18 includes integral fluid channel 20 in frame hinge leaf 8, integral fluid channel 22 in door hinge leaf 24, and integral fluid channel 64 in door 4. Fluid inlet 26 of frame hinge leaf integral fluid channel 20 is in sealed fluid communication with door frame valve 16. Fluid outlet 28 of frame hinge leaf integral fluid channel 20 is in sealed fluid communication with inlet 30 of integral fluid channel 22 in door hinge leaf 24.

One embodiment of the present invention comprises seals 62 to assure adequate sealing at interface of fluid channels 18, 20 with repeated openings and closings of door 4. Seals 62 can be made of resilient material having elastic, compressive characteristics such that adequate sealing at the interface of fluid channels 18, 20 can occur when the door angular position θ is greater than, for example, zero degrees and fluid channels 18, 20 are not perfectly aligned adjacent to each other. Seals 62 can compress slightly as the door transitions from a predetermined angular position θ degrees to about zero degrees. In this embodiment, seals 62 form a part of the single fluid circuit since fluid channels 18, 20 are not in direct contact (see FIG. 2A). Frame hinge leaf 8 can include recessed surface 63 having a depth D from outer edge 65 of frame hinge leaf 8 to provide clearance between fluid channels 18, 20 for seals 62 compression. Alternative embodiments having fluid channels 18, 20 directly contact or where one channel is conically shaped to fit tightly within the other channel are also contemplated within the scope of the invention.

Fluid outlet 66 of door hinge leaf integral fluid channel 22 is in sealed fluid communication with inlet 68 of integral fluid channel 64 in door 4. "Integral fluid channel" means the fluid channel is part of or internal to the component by machining, drilling, casting or molding the channel into the component to form a solid, single part and not an assembly of the channel onto the component. The door frame 42 and door 4 can be made of 304 stainless steel, which provides protection against corrosion.

Figure 3:
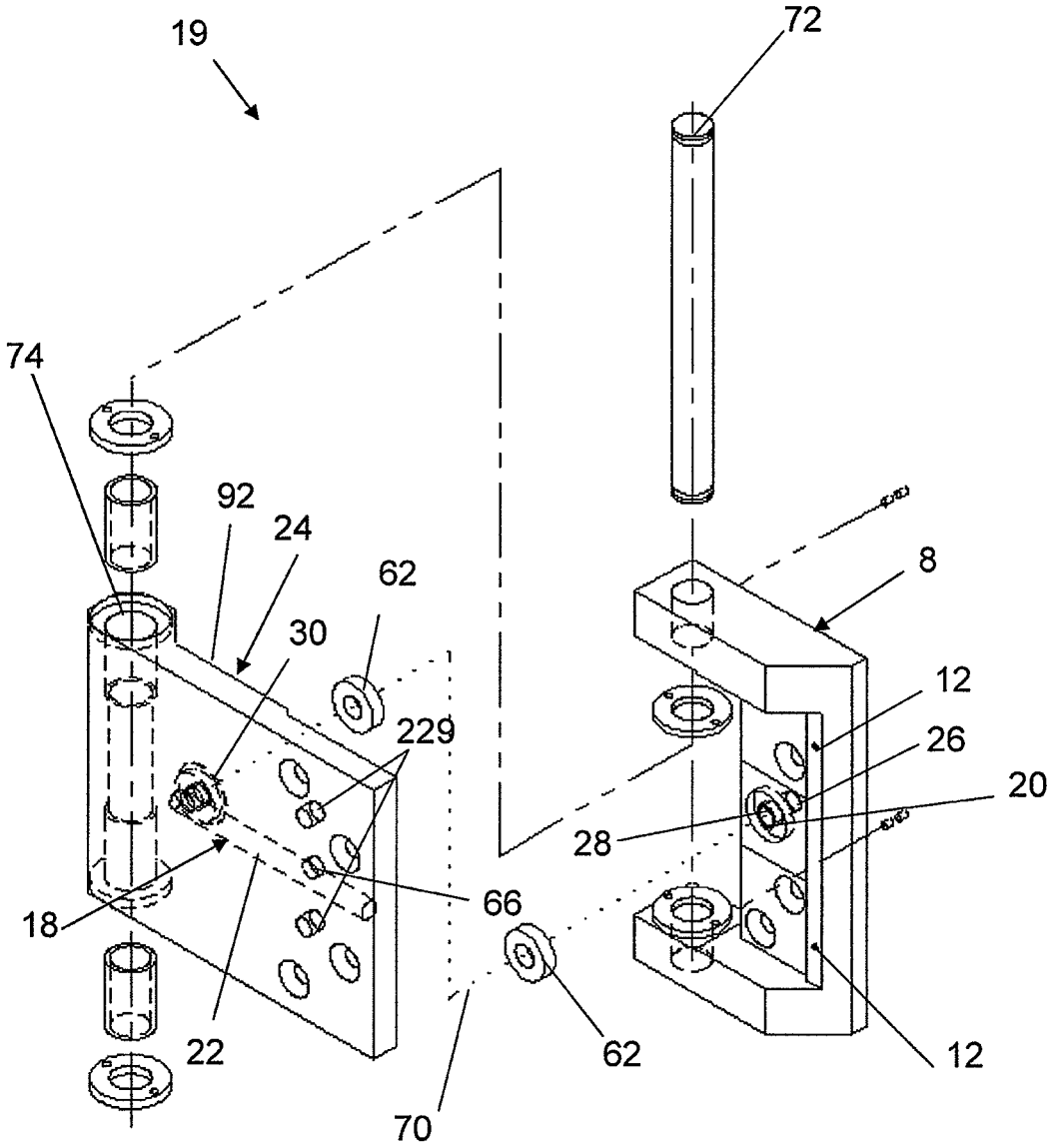
FIG. 3 is an exploded isometric view of the hinge for the shielded door of the present invention.

Now turning to FIG. 3 that illustrates an exploded view of hinge 19 and hinge portion of integral fluid circuit 18. Frame hinge leaf 8 has integral fluid channel 20 with inlet 26 and outlet 28 represented as a dotted or hidden line. Door hinge leaf 24 has integral fluid channel 22 with inlet 30 and outlet 66 represented as a dotted or hidden line. In particular, assembly line 70 indicates the alignment of fluid outlet 28 of frame hinge leaf integral fluid channel 20 with sealed fluid communication with inlet 30 of integral fluid channel 22 in door hinge leaf 24, which include seals 62 therebetween, when door 4 is closed. Also shown in FIG. 3 is air actuation pin hole 12 of frame hinge leaf 8. Two (2) air actuation pins 12 can be drilled in frame hinge leaf 8 (as shown in FIG. 3) to provide reversibility to be able to position frame hinge leaf 8 on the right side or left side of door frame 42. Conventional hinge connecting and pivoting hardware is utilized to pivotally connect frame hinge leaf 8 to door hinge leaf 24, which includes hinge pin 72 and hinge pin hole 74 with accompanying o-rings, wear rings, sleeve bushings, and thrust bushings. The hinge pin 72 interacts with two bronze sleeve bushings, two hinge thrust bearings, two hinge wear rings and two o-rings at the top and bottom of the hinge pin to allow for easy opening and closing of the door.

Figure 5:
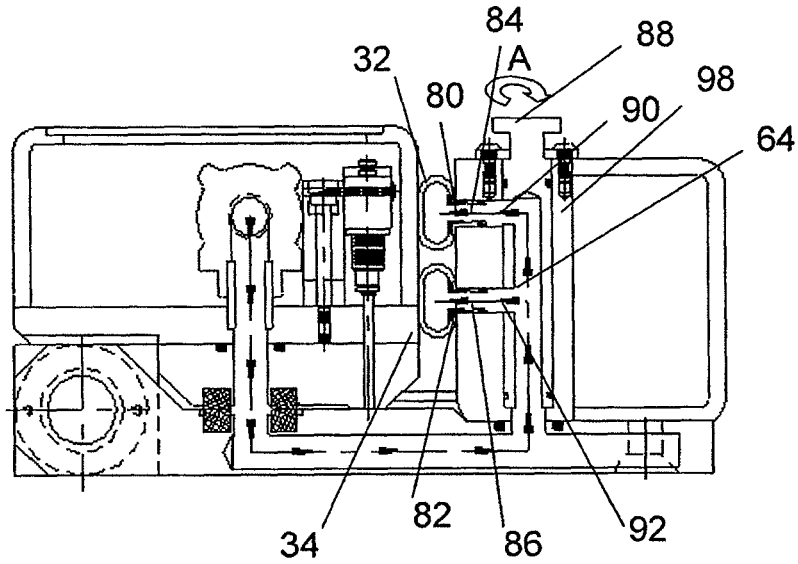
FIGS. 5-7 are cross-sectional views of one air seal selector switch of the present invention to select which air seal receives pressurized air from a pressurization system such as both seals, a primary seal, or a secondary seal.
Figure 6:
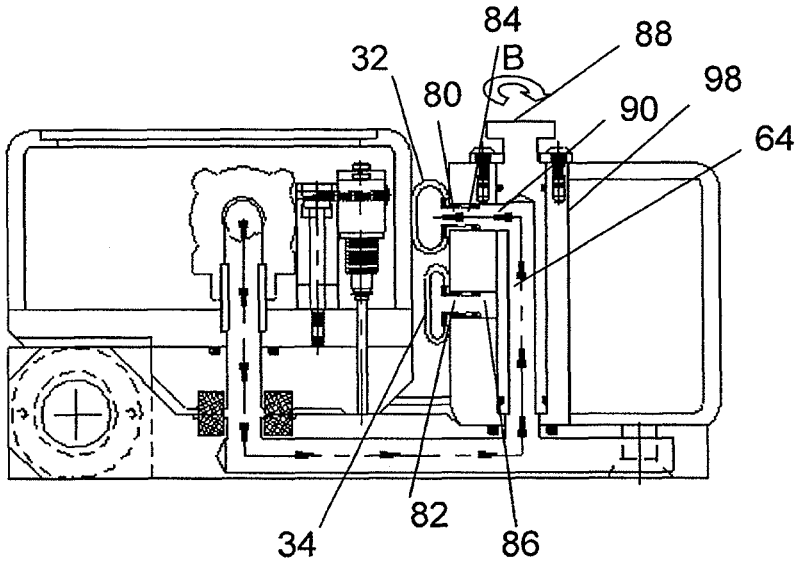
Figure 7:
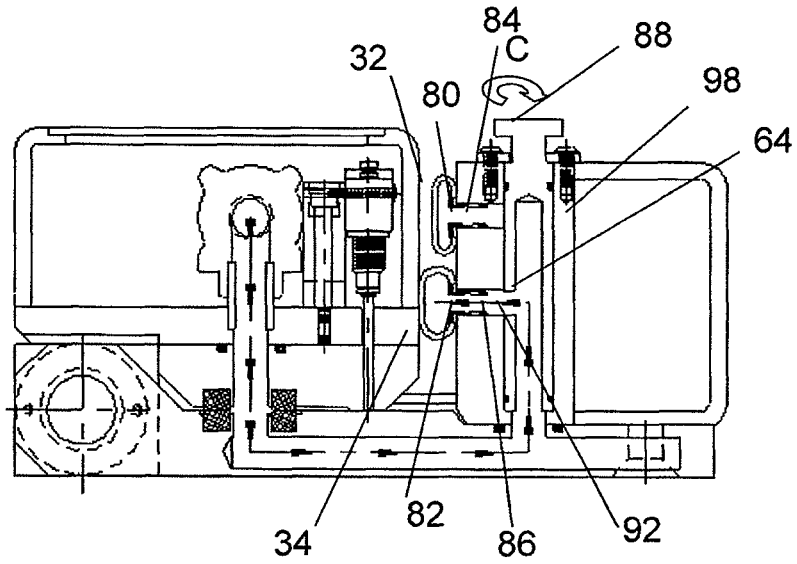

Now turning to FIGS. 5-7 that illustrate one embodiment of an air seal selector switch 88 of the present invention to select which air seal receives pressurized air from a pressurization system such as both air seals 32, 34, a primary air seal 32, or a air secondary seal 34. Channel 64 is now integral with seal selector 88. Seal selector switch 88 is sized to be received into through-bore 98 of door 4 and able to rotate within through-bore 98 to select position A (FIG. 5—open both air outlet channels 84, 86 of channel 64), position B (FIG. 6—only open air outlet channel 84 of channel 64), or position C (FIG. 7—only open air outlet channel 86 of channel 64). Position A allows both air seals 32, 34 to be inflated. Position B only allows for air seal 32 to be inflated. Position C only allows for air seal 34 to be inflated.

Now turning to FIGS. 8A-8D that illustrate of another embodiment of a selector switch of the present invention to select which air seal receives pressurized air from a pressurization system, such as both air seals 32, 34, a primary air seal 32, or a secondary seal 34. This embodiment includes dump valves 60A, 60B at the inlets to air seals 32, 34. Dump valve 60 can be connected to air supply port 202, which is upstream of dump valves 60A, 60B. Dump valve 60 can be used for redundancy and backup if either dump valves 60A, 60B were to fail or to assist in evacuating the air lines quicker or can be eliminated from the fluid network. In other words, dump valve 60 is an optional feature in this alternative embodiment.

Figure 8A:
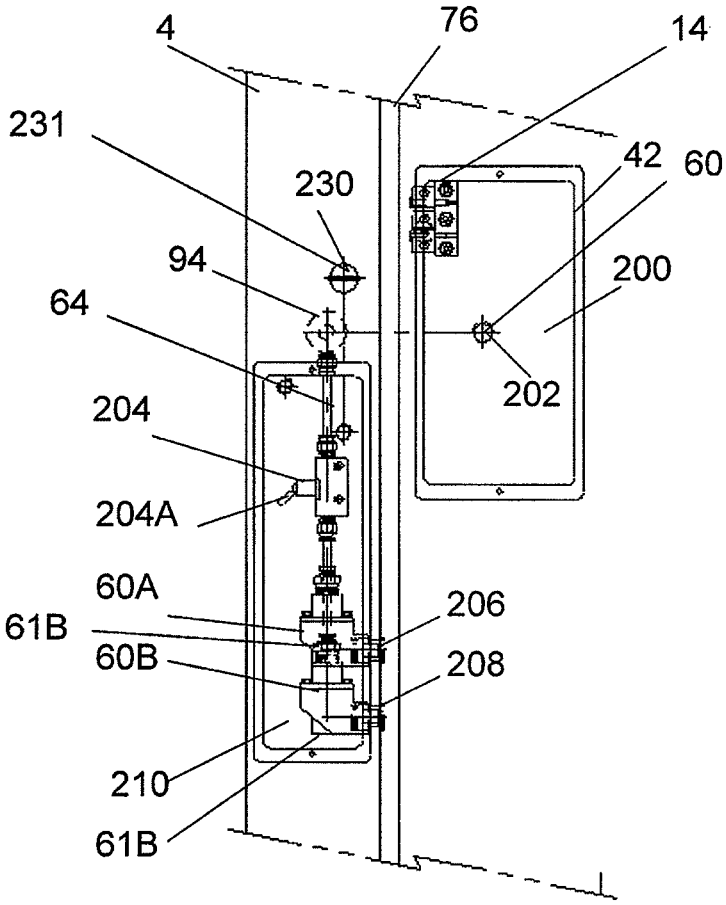
FIG. 8A is a side view of another embodiment of a selector switch of the present invention with access covers removed on the inside.

FIG. 8A is an illustration of door 4 and door frame 42 without access covers showing internal components through door access opening 210 and door frame access opening 200. The fluid network for air seal 32 is shown completely. Whereas, the fluid network for air seal 34 is behind the fluid network for air seal 32 shown in FIG. 8A, but shown completely in FIGS. 8C and 8D. Dump valve 60A is in fluid communication with air seal 32 through air seal connection 206. Dump valve 60B is in fluid communication with air seal 34 through air seal connection 208. Each dump valve 60A, 60B includes an exhaust port 61A, 61B. Air fitting 94 is in fluid communication through channel 64 with air valve 204 with open/close shutoff toggle switch 204A (for example miniature manual air valve manufactured by Ingersoll-Rand/ARO, part number 223-C) that controls air flow to dump valve 60A (for example, manufactured by Deltrol Corp, part number EV25A2). Toggle switch 204A has an open and closed position to manually control flow. However, automated open/closed switches are within the contemplation of this invention.

Continuing with FIG. 8A, air supply port 202 fluidly connects fluid network 18 with air pressurization system 36 (FIG. 2A). As discussed above, dump valve 60 is located upstream of air supply port 202 and dump valves 60A, 60B. Limit switch 14 is also accessible through port 200.

Figure 8B:
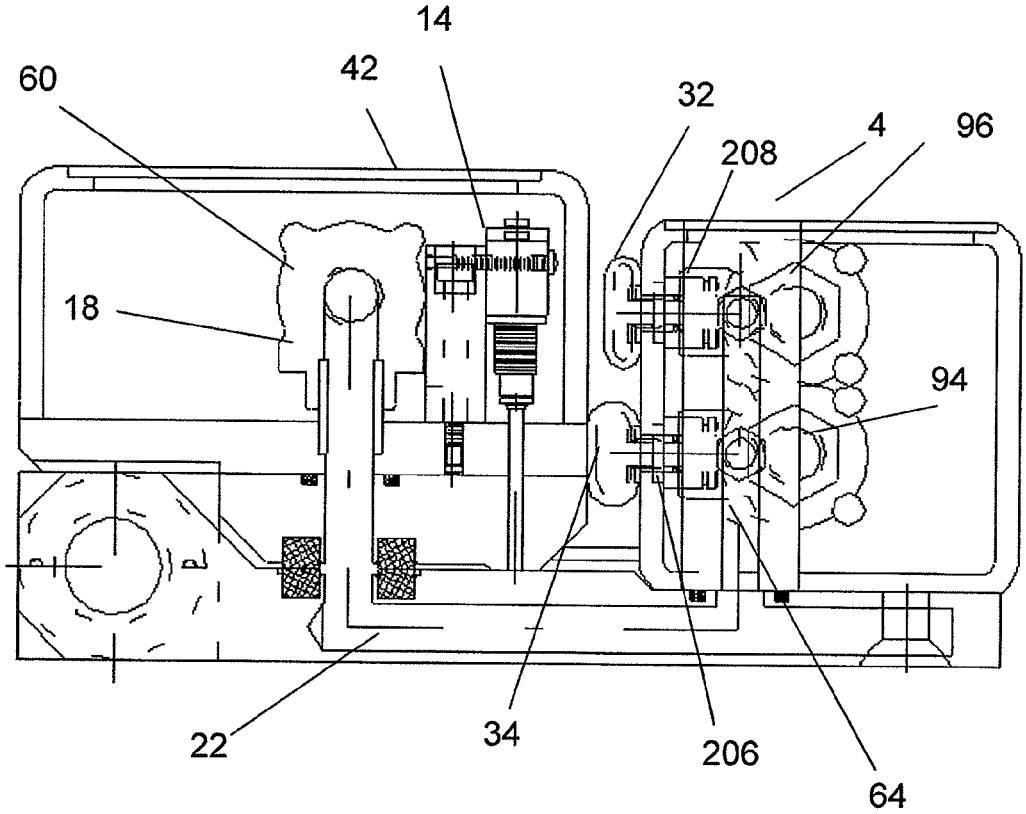
FIG. 8B is a cross-sectional view of the selector switch of FIG. 8A oriented from the top illustrating fluid network 18 from door frame 42.

FIG. 8B is a cross-sectional view of the selector switch of FIG. 8A oriented from the top illustrating fluid network 18 from door frame 42. Optional dump valve 60 is shown connected to fluid network 18. Air seal 32 is shown deflated to illustrate that system 2 maintains shield integrity with redundant air seal 34. Under normal operation, air seal 32 will be inflated similar to air seal 34 and makes contact with inner perimeter 40 of door frame 42 to create a substantial seal between door frame 42 and door 4 without gaps, including corners 78 (FIG. 4).

Figure 8C:
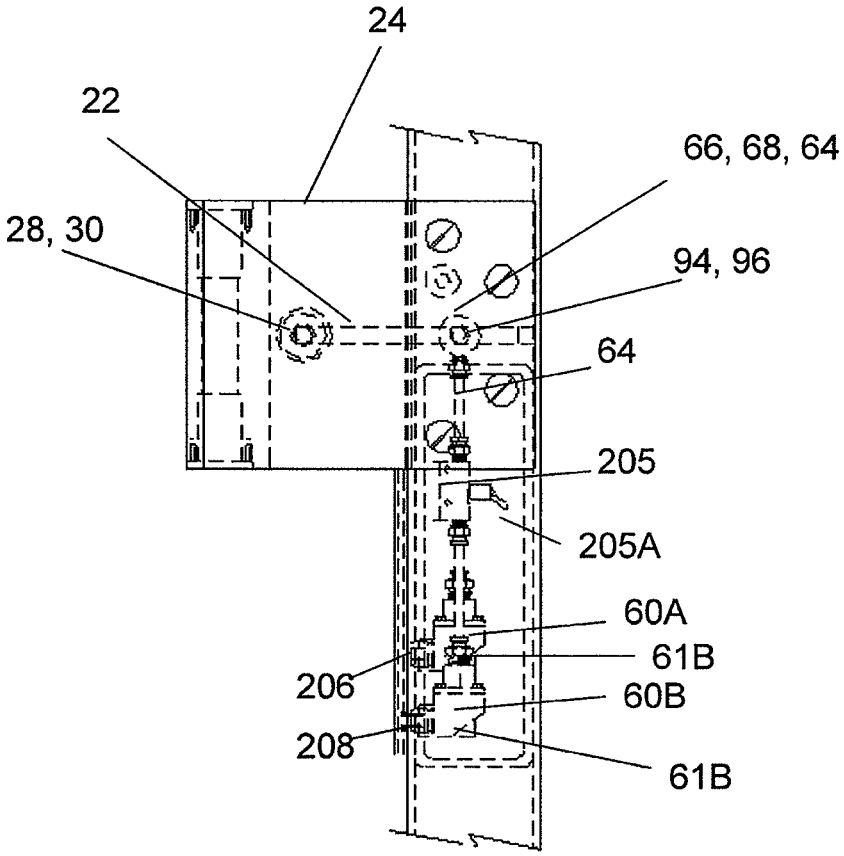
FIG. 8C is a cross-sectional view of the selector switch of FIG. 8A oriented from the outside illustrating an opposite view of FIG. 8A.

FIG. 8C is a cross-sectional view of the selector switch of FIG. 8A oriented from the outside illustrating an opposite view of FIG. 8A. The fluid network for air seal 34 is shown completely. Dump valve 60B is in fluid communication with air seal 34 through air seal connection 208. Dump valve 60B includes an exhaust port 61B. Air fitting 96 is in fluid communication through channel 64 with air valve 205 with open/close shutoff toggle switch 205A (for example miniature manual air valve manufactured by Ingersoll-Rand/ARO, part number 223-C) that controls air flow to dump valve 60B (for example, manufactured by Deltrol Corp, part number EV25A2). Toggle switch 205A has an open and closed position to manually control flow. However, automated open/closed switches are within the contemplation of this invention.

Figure 8D:
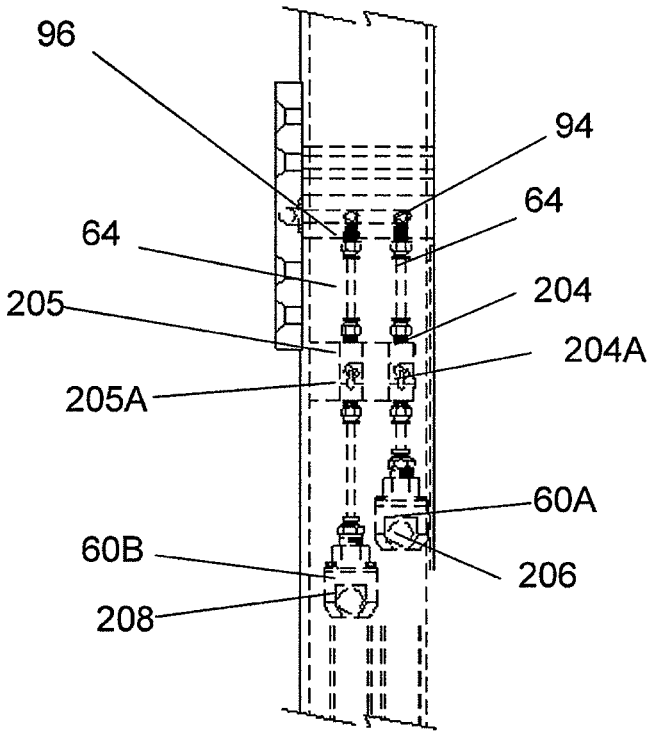
FIG. 8D a cross-sectional side view of the selector switch of FIGS. 8A and 8B shown oriented 90 degrees illustrating the seal air connectors.

FIG. 8D a cross-sectional side view of the selector switch of FIGS. 8A and 8B shown oriented 90 degrees illustrating the seal air connectors. The fluid networks for both air seals 32, 34 are shown completely as discussed above.

Air seals 32, 34 of the present invention can be made of pneumatic tubing such as EPDM rubber or a silicone based compound, include an outer braided or woven metallic covering, and an air stem.

With regards to air seals 32, 34 being made of a rubber material, that material can be EPDM rubber or a silicone based compound. EPDM rubber (ethylene propylene diene Monomer (M-class) rubber), a type of synthetic rubber, is an elastomer which is characterized by wide range of applications. M-class refers to its classification in ASTM standard D-1418. The "M" class includes rubbers having a saturated chain of the polymethylene type. The diene(s) currently used in the manufacture of EPDM rubbers are DCPD (dicyclopentadiene), ENB (ethylidene norbornene) and VNB (vinyl norbornene). The choice of materials is based upon the capability of withstanding repeated pressure cycles and expected temperature extremes that the individual invention would be exposed to with EPDM rubber being the most commonly used of the two. EPDM rubber is designed to operate at maximum air temperatures of about 120° C. to minimum are temperatures of about −54° C.

With regards to air seals 32, 34 including an outer braided or woven metallic covering, the covering is the primary factor of creating the Electromagnetic Interference (EMI) seal between the door frame assembly and the door hinge leaf assembly. This woven or braided metallic material is comprised of fine tin plated/copper wires or stainless steel wires, or monel wires, or any conductive metallic wire based upon environmental conditions such as extreme cold or salt water spray.

With regards to air seals 32, 34 further including an air stem that allows air to enter the air seal 32, 34 from the door 4, the stem creates a tight seal with air channel 64 of door 4.

Secondary RF seal 34 can alternatively be an environmental seal, which is a seal intended to protect the shielded enclosure from weather conditions, as well as redundant shielding if air seal 32 fails.

Installation of seals 32, 34 on to door 4 begins be inserting seal inlets 80, 82 into channel outlets 84, 86 (FIG. 5) or over/into seal air connections 206, 208 (FIG. 8A). Air seals 32, 34 can be in the form of elastic tubing, similar to an inner tube for a bicycle, with any pre-formed shape that facilitates "zero friction" or "near zero friction" condition when deflated. FIG. 2B illustrates air seals 32, 34 as elongated ovals. Other pre-forms of air seals 34, 35 can be D shape with flat side in contact with door outer surface 56. Air seals 32, 34 can have a pre-installed or as-manufactured inner diameter equivalent to or slightly smaller than the outer perimeter 41 of door 4. Air seals 32, 34 have elastic properties such that air seal 32, 34 can be stretched on to the outer perimeter 41 of door 4 when the air seal inner diameter is slightly smaller than the outer perimeter 41 of door 4. Air seals 32, 34 can include adhesive on inner surfaces 33, 35 having a removable strip or paper covering the adhesive. After each air seal 32, 34 is positioned on the outer perimeter 41 of door 4, the removable strip or paper is removed and pressure is applied to the outer surface 37, 39 of air seals 32, 34 to secure the inner surfaces 33, 35 with adhesive to the outer perimeter 41 of door 4 to form an air tight seal between the outer perimeter 41 of door 4 and air seals 32, 34. Before seals 32, 34 are installed, there is a door frame/door gap 45 (FIG. 2A). After seals 32, 34 are installed and in deflated position, there is a door frame/air seal gap 44 (FIG. 2A). When the air seals 32, 34 are inflated, there is no gap. Air seals 32, 34 are removed from the outer perimeter 41 of door 4 by pulling on any part of air seals 32, 34 with sufficient force to overcome the adhesion. The outer perimeter 41 of door 4 is cleaned with an adhesive solvent in preparation of the next air seal installation. The air seal installation and removal/preparation operations each take approximate 15 minutes.

Though this application illustrates two (2) air seals, alternative systems can operate with only one (1) air seal or a plurality of air seals depending on the size of the door and performance requirements of the user.

One embodiment of system 2 includes redundant fluid networks 18 by incorporating two (2) hinges 19 as illustrated in FIG. 4. One hinge 19 can be operable, while the other hinge 19 is deactivated until needed, for example when the first hinge 19 is being repaired. Another embodiment of system 2 only utilizes one (1) hinge 19 and one (1) commercially available hinge (not shown). Yet another embodiment of the present invention may utilize a separate fluid network for each air seal requiring both hinges 19 to be operably connected to the separate fluid network.

Figure 9:
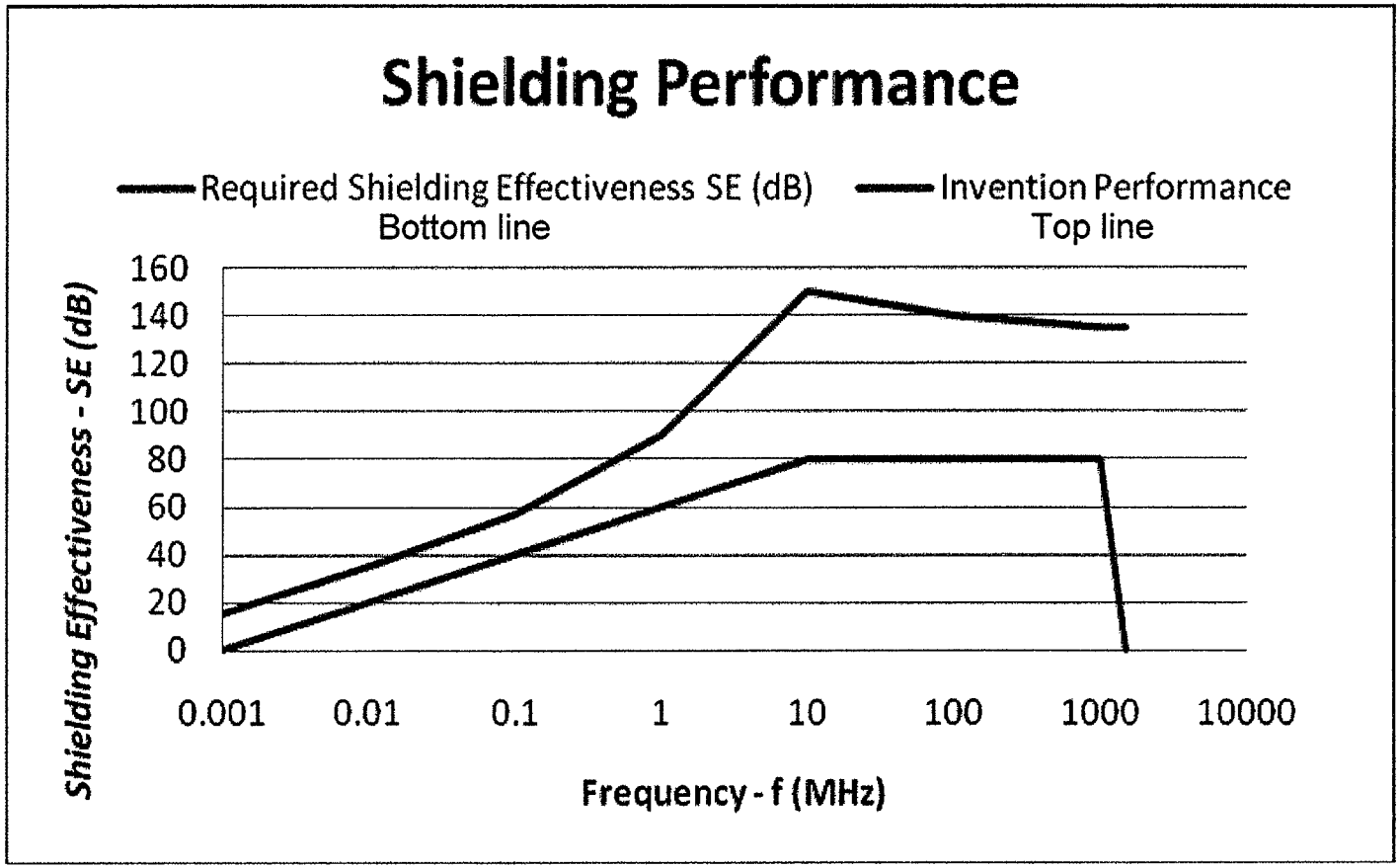
FIG. 9 is a performance chart illustrating the present invention exceeds military specifications (MIL SPEC).

FIG. 9 is shielding performance data of the present invention compared to required shielding effectiveness as a function of frequency as defined by Mil-Std-188-125-1 and Mil-Std-188-125-2. The present invention exceeded performance requirements for frequencies ranging from 0.010 MHz to over 1000 MHz.

Another feature of the present invention are the security screw holes 229 in door hinge leaf 24 (FIG. 3) and door 4 (FIG. 8A) receive security screws 231 (FIG. 8A) to attach door hinge leaf 24 to door 4. Security screw hole 229 is drilled partially through door hinge leaf 24 from the back side 92 (FIG. 3) such that the sealed integrity of system 2 is maintained. Security screw holes 230 of door 4 are through-holes. Security screws 231 are blind attachments since they are attached from the back side of door hinge leaf 24. Door 4 cannot be removed from the outside when door 4 is sealed in closed position (FIG. 4).

While the disclosure has been described in detail and with reference to specific embodiments thereof, it will be apparent to one skilled in the art that various changes and modifications can be made therein without departing from the spirit and scope of the embodiments. Thus, it is intended that the present disclosure cover the modifications and variations of this disclosure provided they come within the scope of the appended claims and their equivalents.

What is claimed is:

1. A door sealing system comprising:

a door frame having an integrally formed fluid channel adapted for fluid communication with a fluid pressurization system;

a door with an outer perimeter and an integrally formed fluid channel;

an inflatable fluid seal disposed along the outer perimeter of the door in fluid communication with the integrally formed fluid channel of the door;

a door hinge having (i) a frame hinge leaf attached to the door frame and (ii) a door hinge leaf attached to the door, wherein the frame hinge leaf and the door hinge leaf are pivotally connected together to vary an angular position of the door relative to the door frame;

wherein the frame hinge leaf includes an integrally formed fluid channel in fluid communication with the integrally formed fluid channel of the door frame;

wherein the door hinge leaf includes an integrally formed fluid channel in fluid communication with the integrally formed fluid channel of the door; and wherein the integrally formed fluid channel of the frame hinge leaf interfaces with the integrally formed fluid channel of the door hinge leaf to form a single internal fluid network between the door frame and the inflatable fluid seal only when the angular position is equal to or less than a predetermined angle defining a closed position of the door, whereby fluid is capable of flowing from the fluid pressurization system through the single internal fluid network to the inflatable fluid seal to inflate the inflatable fluid seal to contact an inner perimeter of the door frame to eliminate a gap formed between the inner perimeter of the door frame and the outer perimeter of the door, and the single internal fluid network cannot be tampered with or cut from an outer side of the door because there are no externally exposed fluid lines.

2. The door sealing system according to claim 1, wherein the door frame further includes a fluid supply assembly in fluid communication with the integrally formed fluid channel of the door frame.

3. The door sealing system according to claim 2, further comprises a limit switch connected to the fluid supply assembly to control fluid flow through the fluid supply assembly to regulate fluid between the fluid pressurization system and the inflatable fluid seal.

4. The door sealing system according to claim 3, wherein the limit switch is open when the door is in the closed position such that fluid flows from the fluid pressurization system to the inflatable fluid seal through the single internal fluid network to inflate the inflatable fluid seal.

5. The door sealing system according to claim 4, wherein the fluid supply assembly further includes a pressure release valve to exhaust fluid from the inflatable fluid seal to deflate the inflatable fluid seal for opening the door.

6. The door sealing system according to claim 3, further comprising a time delay mechanism connected to the limit switch to delay fluid flow from the fluid pressurization system for a predetermined time period until the door rotates to the angular position less than the predetermined angle.

7. The door sealing system according to claim 3, wherein the limit switch is integral to the door frame, and wherein the integral limit switch further comprises a biased actuation pin capable of extending outwardly from the frame hinge leaf an axial distance associated with the predetermined angle.

8. The door sealing system according to claim 7, wherein the biased actuation pin is positioned adjacent the door hinge leaf such that the biased actuation pin contracts an inner surface of the door hinge leaf at the predetermined angle to retract the air actuation pin into the frame hinge leaf to close the integral limit switch that sets a timing delay relay to activate an air solenoid at a predetermined time to allow air to flow through the single internal fluid network to the inflatable fluid seal, whereby the air actuation pin is not accessible from the outer side of the door when the door is in the closed position providing security such that the fluid pressurization system cannot be overridden to open the door from the outer side of the door.

9. The door sealing system according to claim 1, further comprising two separate internal fluid networks when the angular position is greater than the predetermined angle defining an open position of the door, wherein a first separate internal fluid network comprises the integrally formed fluid channel of the door frame and the integrally formed fluid channel of the frame hinge leaf, and wherein a second separate internal fluid network comprises the integrally formed fluid channel of the door and the integrally formed fluid channel of the door hinge leaf.

10. The door system according to claim 1, further comprising a fluid seal selector disposed in the integrally formed fluid channel of the door for regulating fluid into and out of the inflatable fluid seal.

11. The door system according to claim 1 further comprising another inflatable fluid seal disposed along the outer perimeter of the door in fluid communication with the integral fluid channel of the door to form a plurality of inflatable fluid seals.

12. The door system according to claim 11, further comprising an fluid seal selector disposed in the integrally formed fluid channel of the door for regulating fluid into and out of the plurality of inflatable fluid seals.

13. The door sealing system according to claim 1, wherein the door hinge leaf further comprises a security screw hole drilled partially through the door hinge leaf from a back side of the door hinge leaf, wherein the door further comprises a security through-hole, and wherein both holes are sized to receive a security screw when the security through-hole of the door is aligned with the security hole of the door hinge leaf for attachment thereto to form a blind attachment such the door cannot be removed from the outer side of the door when the door is in the closed position.

14. A door sealing system comprising, a fluid pressurization system;

an inflatable fluid seal disposed along an outer perimeter of a door and in a gap formed by an inner perimeter of a door frame and the outer perimeter of the door; and an internal fluid network in fluid communication between the fluid pressurization system and the inflatable fluid seal, wherein the internal fluid network comprises a first integrally formed fluid channel disposed in a door frame, a second integrally formed fluid channel disposed in a door hinge, and a third integrally formed fluid channel disposed in the door, wherein the second integrally formed fluid channel interconnects with the first integrally formed fluid channel and the third integrally formed fluid channel, whereby fluid from the fluid pressurization system inflates the inflatable fluid seal to close the gap to form a substantially impermeable barrier against radio frequency transmission and air infiltration.

15. The door sealing system according to claim 14, further comprises at least two inflatable fluid seals.

16. The door sealing system according to claim 15, further comprising a fluid seal selector disposed in the internal fluid network for directing fluid to one, both, or none of the least two inflatable fluid seals.

17. The door sealing system according to claim 14, wherein the door hinge comprises a frame hinge leaf and a door hinge leaf pivotally connected together, wherein integrally formed fluid channels of each are (i) interconnected when the door hinge is in a closed position and (ii) not interconnected when the door hinge is in an opened position.

* * * * *